US008754621B2

(12) United States Patent
El-Nozahi

(10) Patent No.: US 8,754,621 B2
(45) Date of Patent: Jun. 17, 2014

(54) HIGH POWER SUPPLY REJECTION LINEAR LOW-DROPOUT REGULATOR FOR A WIDE RANGE OF CAPACITANCE LOADS

(71) Applicant: Vidatronic, Inc., College Station, TX (US)

(72) Inventor: Mohamed Ahmed Mohamed El-Nozahi, Heliopolis (EG)

(73) Assignee: Vidatronic, Inc., College Station, TX (US)

( * ) Notice: Subject to any disclaimer, the term of this patent is extended or adjusted under 35 U.S.C. 154(b) by 0 days.

(21) Appl. No.: 13/830,275

(22) Filed: Mar. 14, 2013

(65) Prior Publication Data

US 2013/0271100 A1 Oct. 17, 2013

Related U.S. Application Data

(60) Provisional application No. 61/624,907, filed on Apr. 16, 2012.

(51) Int. Cl.
*G05F 1/00* (2006.01)

(52) U.S. Cl.
USPC ..... 323/280; 323/273

(58) Field of Classification Search
USPC ..... 323/222–225, 269–277, 280–285
See application file for complete search history.

(56) References Cited

U.S. PATENT DOCUMENTS

| | | | | |
|---|---|---|---|---|
| 2005/0225306 | A1* | 10/2005 | Oddoart et al. | 323/274 |
| 2005/0242796 | A1* | 11/2005 | Yang et al. | 323/282 |
| 2007/0018621 | A1* | 1/2007 | Mok et al. | 323/280 |
| 2007/0121944 | A1* | 5/2007 | Lee et al. | 380/263 |
| 2007/0241730 | A1* | 10/2007 | Dow et al. | 323/280 |
| 2008/0169795 | A1* | 7/2008 | Wang | 323/280 |
| 2008/0284394 | A1* | 11/2008 | Yin et al. | 323/282 |
| 2011/0285456 | A1* | 11/2011 | Thornton et al. | 327/541 |
| 2012/0038332 | A1* | 2/2012 | Lin | 323/277 |
| 2012/0212199 | A1* | 8/2012 | Amer et al. | 323/280 |
| 2012/0212200 | A1* | 8/2012 | Amer et al. | 323/282 |
| 2012/0262135 | A1* | 10/2012 | Childs | 323/269 |
| 2012/0262138 | A1* | 10/2012 | Srinivasan et al. | 323/279 |

* cited by examiner

*Primary Examiner* — Timothy J Dole
*Assistant Examiner* — Yusef Ahmed
(74) *Attorney, Agent, or Firm* — Osha Liang LLP

(57) ABSTRACT

A method to maintain stability of a low drop-out linear voltage regulator (LDO) includes sensing, by a voltage controlled variable resistor, a node voltage in a feedback network of the LDO linear voltage regulator, wherein the feedback network includes an error amplifier configured to regulate an output voltage level of the LDO based on a reference voltage, wherein the node voltage has a dependency on a resistive load current of the LDO, and adjusting, by the voltage controlled variable resistor and based on the sensed node voltage, a resistance value of a RC network in the feedback network, wherein the adaptive RC network produces an adaptive zero in a transfer function of the feedback network, wherein the adaptive zero reduces phase margin degradation due to an output non-dominant pole in the transfer function, and wherein a frequency of the adaptive zero is inversely proportional to the resistance value.

13 Claims, 5 Drawing Sheets

HIGH POWER SUPPLY REJECTION LINEAR LOW-DROPOUT REGULATOR FOR A WIDE RANGE OF CAPACITANCE LOADS

CROSS-REFERENCE TO RELATED APPLICATIONS

This application claims benefit under 35 U.S.C. §119(e) of U.S. Provisional Patent Application No. 61/624,907, filed on Apr. 16, 2012, and entitled "High Power Supply Rejection Linear Low-Dropout regulator for a wide range of capacitance loads."

BACKGROUND

FIG. 1 shows a schematic block diagram of an LDO (low-dropout) linear voltage regulator (100) with high power supply rejection (PSR). The LDO linear voltage regulator is commonly referred to as simply "LDO." As shown in FIG. 1, The feedback network (101), including a resistor divider and an error amplifier (102), regulates the DC output voltage $V_{out}$ to a desired level. The error amplifier (102) may be a single stage or multi-stage amplifier. The pass transistor $M_{pass}$ may be either a field effect transistor (FET) or a bipolar transistor, and may be of either n-type or p-type. Multi-stage and high-gain amplifiers are typically used as the implementation of the error amplifier in the feedback network circuitry. Improved implementations of the feedback network (101), in accordance with embodiments of the invention, are shown in FIGS. 2 and 3.

Further as shown in FIG. 1, the supply rejection network (103) replicates the input ripples at the gate of the pass transistor $M_{pass}$ to achieve high PSR. The supply rejection network (103) is shown in FIG. 1 in a feed-forward network configuration and may be adapted to change the amplitude of the replicated ripples at the gate of the transistor $M_{pass}$ for different values of output load.

SUMMARY

In general, in one aspect, the invention relates to a linear voltage regulator (LVR) circuit that includes a resistive divider, a first amplifier having a first input coupled to an output of the resistive divider and a first output coupled to a second amplifier, the second amplifier having a second input coupled to the first output of the first amplifier and a second output coupled to a third amplifier, the third amplifier having a third input coupled to the second output of the second amplifier and a third output driving a pass transistor, the pass transistor having a gate terminal driven by the third amplifier, a first terminal coupled to an input of the LVR circuit, and a second terminal coupled to an output of the LVR circuit, a first capacitor coupling the output of the LVR circuit and the first output of the first amplifier, a second capacitor in series with a resistor coupling the second input and the second output of the second amplifier, a first transconductance amplifier having a fourth input coupled to the output of the resistive divider and a fourth output coupled to the second output of the second amplifier, and a second transconductance amplifier having a fifth input coupled to the first output of the first amplifier and a fifth output coupled to the output of the LVR circuit.

In general, in one aspect, the invention relates to a linear voltage regulator (LVR) circuit that includes a resistive divider, a first amplifier having a first input coupled to an output of the resistive divider and a first output coupled to a second amplifier, the second amplifier having a second input coupled to the first output of the first amplifier and a second output coupled to a third amplifier, the third amplifier having a third input coupled to the second output of the second amplifier and a third output driving a pass transistor, the pass transistor having a gate terminal driven by the third amplifier, a first terminal coupled to an input of the LVR circuit, and a second terminal coupled to an output of the LVR circuit, a capacitor coupling the output of the LVR circuit and the first output of the first amplifier, and a supply rejection circuit having a fourth input coupled to the input of the LVR circuit and a fourth output coupled to the second output of the second amplifier.

In general, in one aspect, the invention relates to a method to maintain stability of a low drop-out (LDO) linear voltage regulator over a plurality of capacitive load conditions ranging from no capacitive load to tens of nano-Farads loads. The method includes sensing, by a voltage controlled variable resistor, a node voltage in a feedback network of the LDO linear voltage regulator, wherein the feedback network comprises an error amplifier configured to regulate an output voltage level of the LDO linear voltage regulator based on a reference voltage, wherein the node voltage has a dependency on a resistive load current of the LDO linear voltage regulator, and adjusting, by the voltage controlled variable resistor and based on the sensed node voltage, a resistance value of a RC network in the feedback network, wherein the adaptive RC network produces an adaptive zero in a transfer function of the feedback network, wherein the adaptive zero reduces phase margin degradation due to an output non-dominant pole in the transfer function, and wherein a frequency of the adaptive zero is inversely proportional to the resistance value.

Other aspects of the invention will be apparent from the following description and the appended claims.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1:
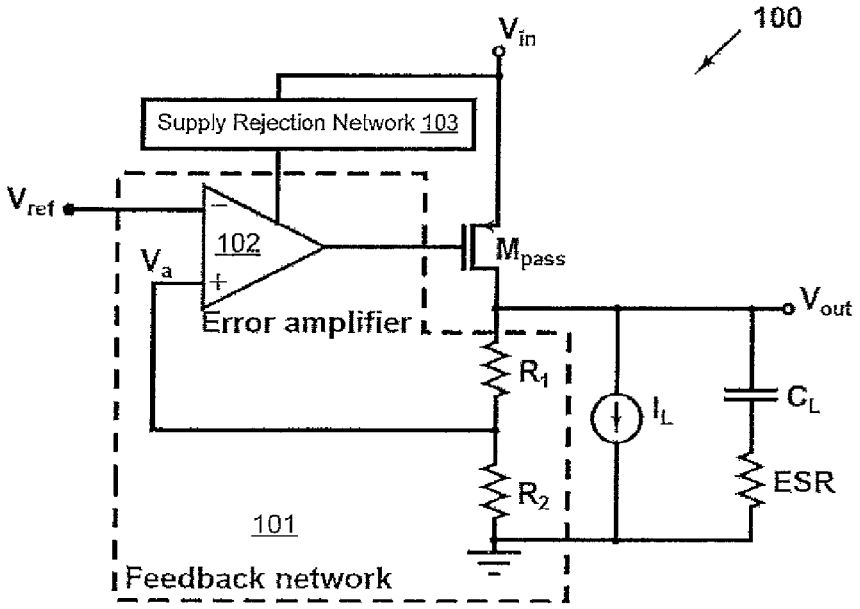
FIG. 1 is a schematic block diagram of an LDO linear voltage regulator, in which embodiments of the invention may be implemented.

Aspects of the present disclosure are shown in the above-identified drawings and described below. In the description, like or identical reference numerals are used to identify common or similar elements. The drawings are not necessarily to scale and certain features may be shown exaggerated in scale or in schematic in the interest of clarity and conciseness.

Embodiments of the invention relate to an LDO linear voltage regulator with an improved feedback network that is capable of driving a load capacitance ranging from 0 to a value greater than tens of nano-Farads (nF). This LDO linear voltage regulator has an improved error amplifier architecture that supports a wide range of load currents (e.g., larger than 100 mA) and provides high PSR up to very high frequencies (e.g., in the megahertz frequency ranges). Methods and or circuits used to achieve the LDO linear voltage regulator stability and high PSR are the main focus of this improved feedback network for the LDO linear voltage regulator. In one or more embodiments of the invention, the LDO linear voltage regulator with the improved feedback network is implemented on a microchip, such as a semiconductor integrated circuit. Throughout this disclosure, the term "LDO," "LDO linear voltage regulator," and "LDO linear voltage regulator with the improved feedback network" may be used interchangeably based on the context.

Figure 2:
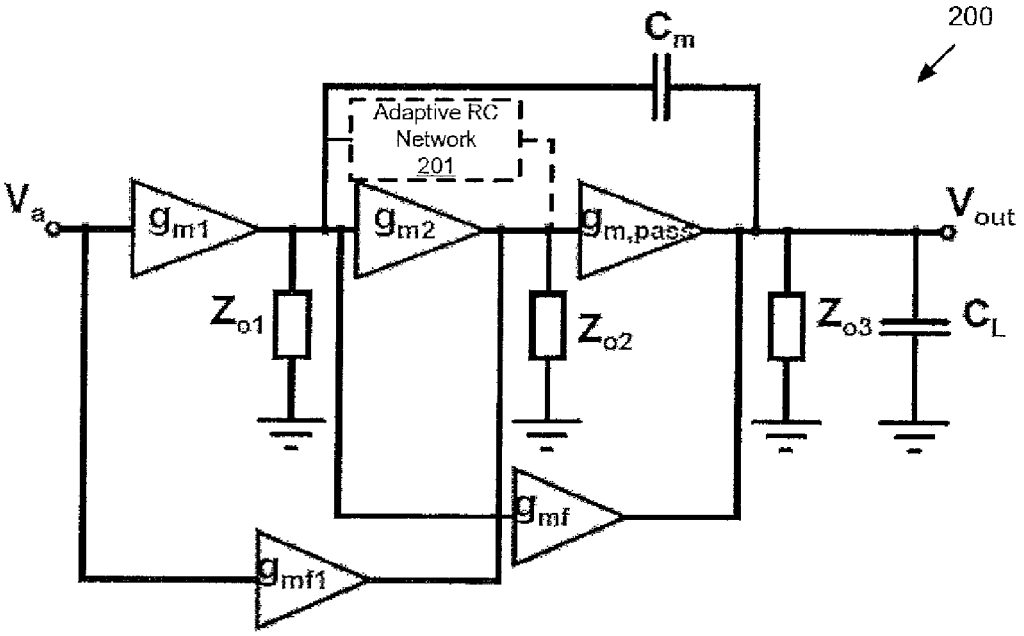
FIG. 2 is a block-level circuit diagram of an error amplifier with an optional adaptive RC network in accordance with embodiments of the invention.

FIG. 2 shows an example equivalent circuit of an error amplifier (200) having multiple amplification stages with frequency compensation that may be used to improve the feedback network (101) in LDO (100), where $g_{m,pass}$ represents the gate-to-drain equivalent circuit of $M_{pass}$ in FIG. 1. As shown in FIG. 2, the error amplifier (200) further includes $g_{m1}$, $g_{m2}$, $g_{mf1}$, $g_{mf}$. In this architecture, $g_{gm1}$, $g_{m2}$ and $g_{m,pass}$ provide multi-stage voltage amplification, and the additional transconductances $g_{mf1}$ and $g_{mf}$ improves the driving capability of the LDO (100) to drive large capacitive loads, while allowing a small value or physical size for capacitor $C_m$ to be used. In one or more embodiments, this technique assumes that the load is purely capacitive, and the last stage of the error amplifier (200) does not supply current to a resistive load. In such embodiments, a low gain is provided by $g_{m,pass}$ and $g_{m2}$ for the amplifier to have good stability across wide capacitive load variations. The low loop gain limits the PSR that this architecture provides to lower than 50 dB. Furthermore this architecture is not suitable for large load current (resistive) variations ranging from 0 to approximately 100-200 mA. To address these limitations, in one or more embodiments, an adaptive RC network (201) is inserted in the error amplifier (200) to improve its operation. Details of the adaptive RC network (201) are described in reference to FIG. 3 below.

Using the LDO (100) shown in FIG. 1 with the amplifier structure in FIG. 2 without the adaptive RC network (201), the LDO (100) can typically achieve higher than 60 dB of PSR at DC, and higher than 50 dB at 10 MHz if an external capacitor is used at the output. On the other hand, the PSR of the LDO (100) without an external capacitor (referred to as a capless LDO) is typically higher than 60 dB at DC, and reduces to close to 0 dB at 1 MHz. This presents a limitation in using a capless LDO. Improved performance of the LDO (100) using the adaptive RC network (201) are described in reference to FIG. 3 below.

Figure 3:
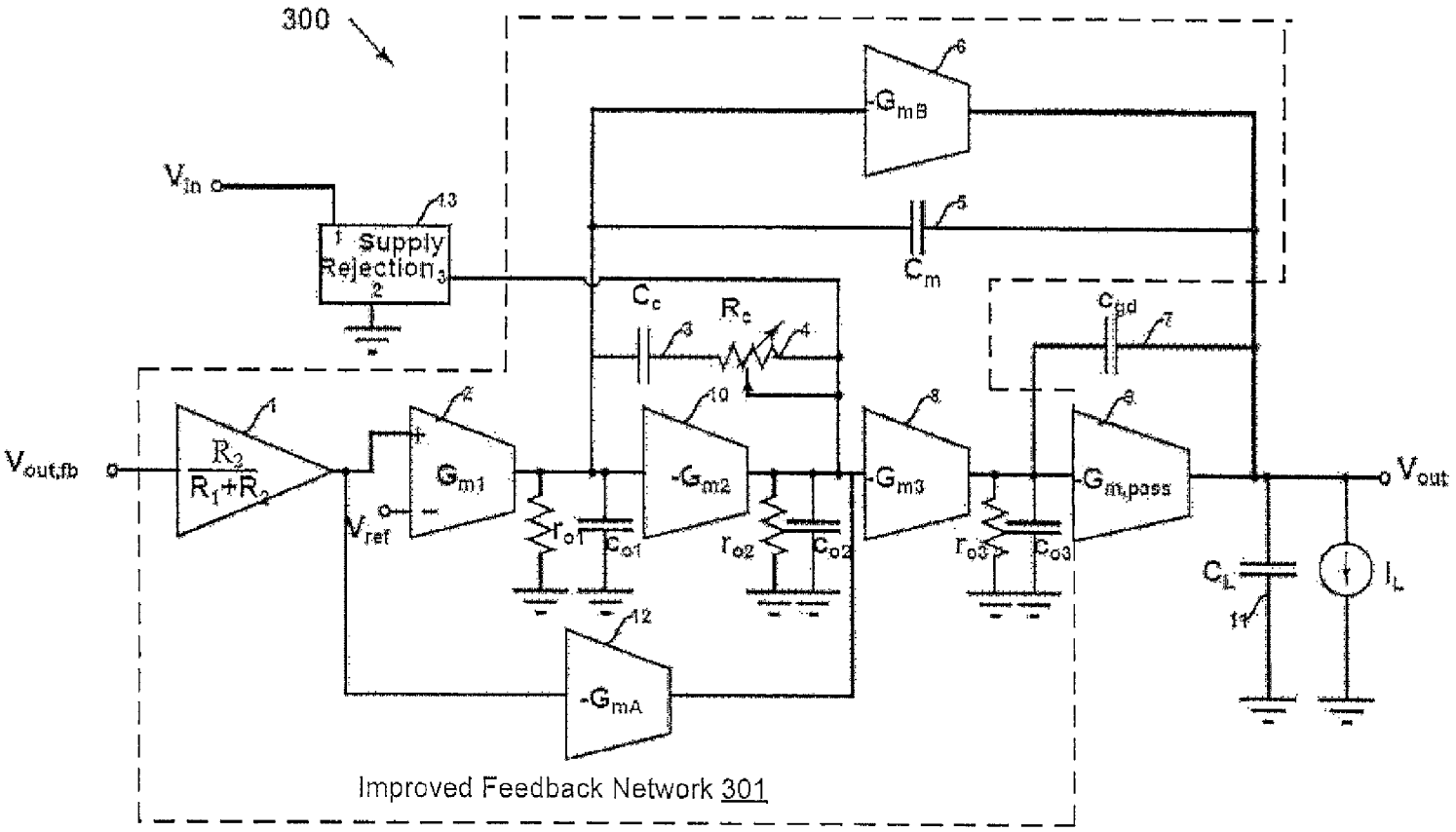
FIG. 3 is a block-level circuit diagram of an improved feedback network for an LDO linear voltage regulator in accordance with embodiments of the invention.

FIG. 3 is a block-level circuit diagram of a LDO linear voltage regulator (300) having an improved feedback network (301) in accordance with embodiments of the invention. In one or more embodiments of the invention, one or more of the modules and elements shown in FIG. 3 may be omitted, repeated, and/or substituted. Accordingly, embodiments of the invention should not be considered limited to the specific arrangements of modules shown in FIG. 3. In one or more embodiments, the improved feedback network (301) replaces the prior art feedback network shown in FIG. 1. Specifically, the error amplifier shown in FIG. 1 is replaced by a new architecture to improve the feedback network allowing support for a wider range of the load capacitances. In other words, the LDO (300) is based on the LDO (100) where the feedback network (101) is implemented using the improved feedback network (301) instead of the prior art.

As shown in FIG. 3, the improved feedback network (301) includes $R_2/(R_1+R_2)$, $G_{m1}$, $G_{m2}$, $G_{m3}$, $G_{mB}$, $R_c$, and $C_c$. In particular, $R_c$, and $C_c$ correspond to the adaptive RC network (201) shown in FIG. 2 above. Based on this added RC network, the improved feedback network (301) improves stability of the LDO (300), over the prior art for wide range of capacitive and resistive (or current) loads. In one or more embodiments, the resistor divider network formed by $R_1$ and $R_2$ may be omitted. In one or more embodiments, the capacitive loads may vary from 0 to loads larger than tens of nano-Farads, and the load currents may vary from 0 to values larger than 100 mA. The LDO (300) with the improved feedback network (301) is shown in FIG. 3 in an open loop configuration to illustrate the frequency compensation. In one or more embodiments, the terminals $V_{out}$ and $V_{out,fb}$ of the LDO (300) are connected together to form the closed loop configuration shown in FIG. 1. In other words, with the exception of being shown in the open loop configuration, the LDO (300) is essentially the same as the LDO (100) where the feedback network (101) is implemented using the improved feedback network (301). As shown, $C_{gd}$ (i.e., circuit element (7)) of the LDO (300) corresponds to the gate-to-drain capacitance of the pass transistor $M_{pass}$ of the LDO (100).

Whether shown in the closed loop configuration as LDO (100) in FIG. 1, or the open loop configuration as LDO (300) in FIG. 3, the output capacitance $C_L$ and the output resistance $R_L=V_{out}/I_L$ produce the output pole (at the pole frequency equal to $1/(R_L*C_L)$) that degrades the phase margin of the transfer function $V_{out}/V_a$ in FIG. 2 or $V_{out}/V_{out,fb}$ in FIG. 3. As is known to those skilled in the art, a pole or a zero of a transfer function (e.g., $V_{out}/V_{out,fb}$) refers to a frequency at which the transfer function becomes infinity or zero, respectively. Because the output pole changes its frequency value with the change in the DC output load current $I_L$, the LDO can be unstable with a wide range of variations in DC load current $I_L$. Throughout this disclosure, the term "stable" and "stability" refer to a circuit operating condition where every bounded input produces a bounded output. In other words, the circuit does not produce an oscillating output when no input signal is applied. In contrast, the term "unstable" and "instability" refer to an opposite circuit operating condition where even bounded input may produce a non-bounded output. In other words, the circuit may produce an oscillating output when no input signal is applied.

For stable operation, feedback loop(s) of the LDO (300) are compensated under various load conditions. As shown in FIG. 3, the compensation scheme of an inner loop (one of the feedback loops) of the LDO (300) is based on adding C, and a variable resistance $R_c$ (i.e., circuit elements (3) and (4), respectively) to $G_{m2}$, $G_{m3}$, $G_{m,pass}$ and $C_m$ (i.e., circuit elements (10), (8), (9) and (5), respectively) in the improved feedback network (301). In one or more embodiments, the minus signs in front of the labels $G_{mA}$, $G_{mB}$, $G_{m3}$, and $G_{m,pass}$ in FIG. 3 indicate that these labels correspond to inverting amplifiers. Further, $G_{mA}$ and $G_{mB}$, may be the same as $G_{mf1}$ and $G_{mf}$, respectively, shown in FIG. 2. The capacitor C, helps to limit the gain of the inner loop (given by $G_{m2}*r_{o2}*C_m/(C_c+C_m)$) to avoid any instability for different load conditions. The variable resistance $R_c$ automatically adapts its value based on the DC voltage level at the output of $G_{m2}$, this output depends on the load current to improve the stability of the inner loop across large load variations. Specifically, the variable resistance $R_c$ and the capacitor $C_c$ produce an adaptive (variable) zero (at the zero frequency equal to $1/(R_c*C_c)$) in the transfer function $V_{out}/V_{out,fb}$. In one or more embodiments, the values of $R_c$ and $C_c$ are chosen such that this adaptive zero partially cancels (i.e., reduces) the effect of the output pole (at the pole frequency equal to $1/(R_L*C_L)$) that degrades the phase margin of the transfer function of the inner loop. With this adaptive zero reducing the effect of the output pole, the LDO (300) is more stable with the DC load current variations. In one or more embodiments, the value of the variable resistance $R_c$ is controlled by sensing any internal node voltage in the feedback network that has dependency on the load current (or output load resistance, $R_L$). For example, the value of the variable resistance $R_c$ may be controlled based on the node voltage at the output of $G_{m1}$, $G_{m2}$ or $G_{m3}$, shown in FIG. 3.

As shown in FIG. 3, the outer loop of the LDO (300) includes $R_2/(R_1+R_2)$, $G_{m1}$, $G_{m2}$, $G_{m3}$, $G_{mA}$, $G_{mB}$, $R_c$, $C_c$, $r_{o1}$, $r_{o2}$, $r_{o3}$, $c_{o1}$, $c_{o2}$ and $c_{o3}$. In particular, $r_{o1}$, $r_{o2}$, and $r_{o3}$ represent equivalent resistances at the output nodes of the transconductance amplifiers $G_{m1}$, $G_{m2}$, and $G_{m3}$, respectively. Further, $c_{o1}$, $c_{o2}$, and $c_{o3}$ represent equivalent capacitances at the output nodes of the transconductance amplifiers $G_{m1}$, $G_{m2}$, and $G_{m3}$, respectively. Depending on particular values of these components, the dominant pole of the transfer function $V_{out}/V_{out,fb}$ at the output of $G_{m1}$ with frequency equal to $1/(r_{o1}*(C_m*G_{m2}*r_{o2}*G_{m3}*r_{o3}*G_{m,pass}*R_L+C_c*G_{m2}*r_{o2}))$ and the non-dominant poles with the frequencies equal to $1/(r_{o3}*c_{o3})$ and $1/(R_L*C_L)$ may result in instability of the LDO (300). Increasing the value of $C_m$ and $C_c$ solves this issue, but results in a lower gain-bandwidth product of the transfer function $V_{out}/V_{out,fb}$ thus slowing the loop response of the outer loop and degrading the PSR performance of the LDO (300). Additionally, the larger value of $C_m$ and $C_c$ requires larger microchip area (e.g., silicon area), which increases the manufacturing cost. In one or more embodiments, two feed-forward paths $G_{mA}$ and $G_{mB}$ (i.e., circuit elements (12) and (6), respectively) produce two additional zeros (a left hand plane zero at $G_{m1}*G_{m2}/(G_{mA}*C_m)$ and a right hand plane zero at $G_{mA}*G_{m,pass}/(G_{m1}*c_{o2})+G_{m1}*G_{m2}/(G_{mA}*C_m)$) for compensating the LDO (300). The two feed-forward paths $G_{mA}$ and $G_{mB}$ allows lower values for $C_m$ and $C_c$ to be used for increasing the PSR at higher frequencies (in MHz range) and results in a stable operation of the LDO (300). Simulations show that adding $C_c$ and variable $R_c$, to the feed-forward paths $G_{mA}$ and $G_{mB}$ in LDO (300) increases the worst case phase margin from 10 degrees (such as LDO (100) and amplifier structure in FIG. 2 with the feed-forward paths $g_{mf1}$ and $g_{mf}$) to 45 degrees without increasing the capacitance values of $C_c$ and $C_m$. This enables the LDO (300) to supply a load current of 500 mA with PSR higher than 30 dB at 1 MHz. The PSR is higher than 50 dB at 1 MHz for a maximum load current of 150 mA using optimum component values. In all the simulated examples, load capacitances larger than 1 nF are supported by the LDO (300) with the improved feedback network (301), while using prior art error amplifier of FIG. 2 in LDO (100) can only achieve comparable performance with much lower capacitive loads (e.g., up to 100 pF).

Figure 4:
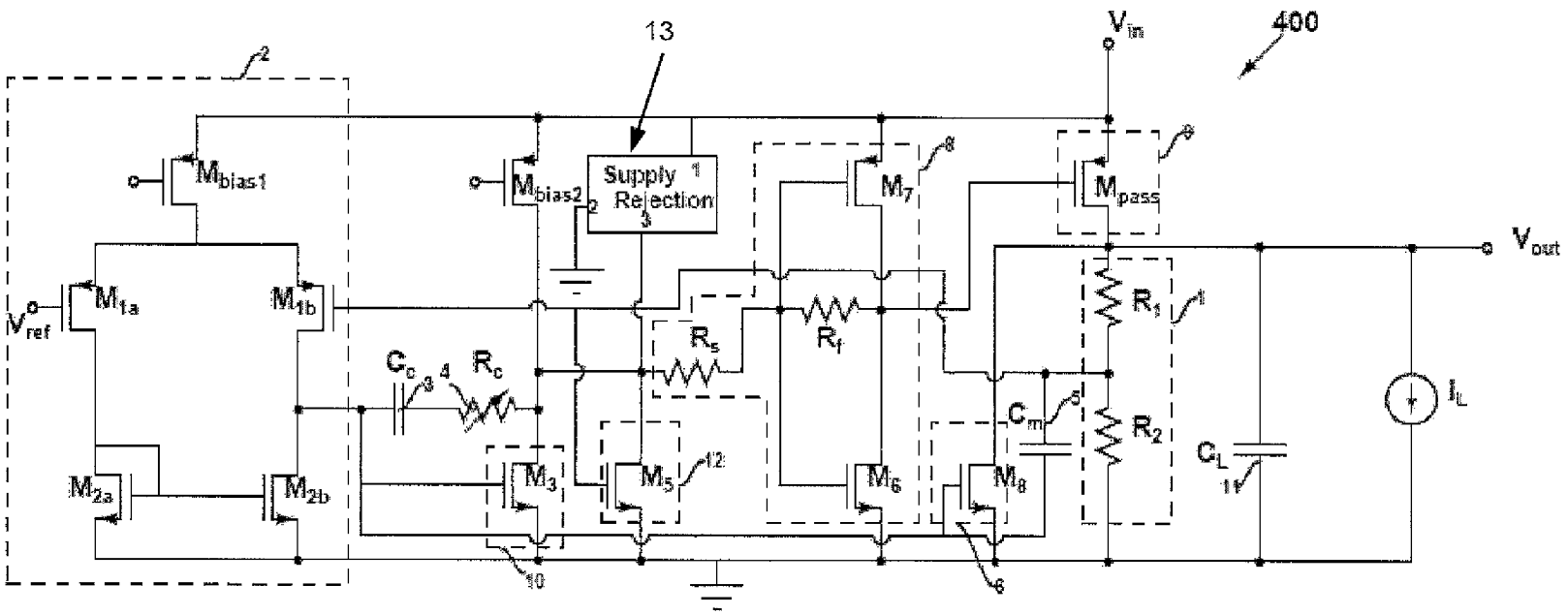
FIG. 4 is an example schematic circuit diagram of an LDO linear voltage regulator using the improved feedback network in accordance with embodiments of the invention.

FIG. 4 is one possible schematic circuit diagram of an LDO linear voltage regulator (400) using an improved feedback network in accordance with embodiments of the invention. In one or more embodiments of the invention, one or more of the modules and elements shown in FIG. 4 may be omitted, repeated, and/or substituted. Accordingly, embodiments of the invention should not be considered limited to the specific arrangements of modules shown in FIG. 4. In one or more embodiments, the LDO (400) is implemented by replacing the feedback network (101) in the LDO (100) shown in FIG. 1 with the improved feedback network (300) shown in FIG. 3.

Corresponding circuit elements are denoted using the same reference numerals in FIGS. 3 and 4. For example, $G_{mA}$ and $G_{mB}$ (denoted in FIG. 3 as circuit elements (12) and (6), respectively) are implemented using the transistors $M_5$ and $M_8$ (denoted in FIG. 4 as circuit elements (12) and (6), respectively). The gain stage $G_{m3}$(denoted in FIG. 3 as circuit element (8)) and $r_{o3}$ are implemented using an amplifier (denoted in FIG. 4 as circuit element (8)) with resistive feedback composed of $R_5$, $R_f$, $M_7$ and $M_6$. This makes the gain substantially constant across fabrication process variations, which results in high fabrication yield.

Figure 5:
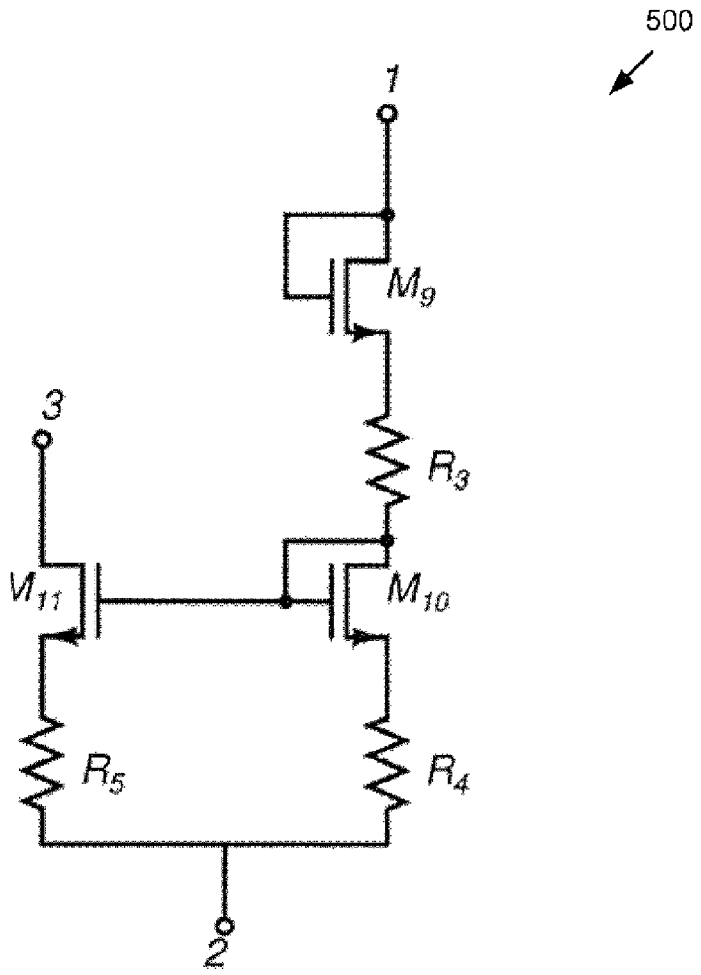
FIG. 5 is a schematic circuit diagram of a supply rejection circuit used in conjunction with the improved feedback network in accordance with embodiments of the invention.

The circuit element (13) in FIGS. 3 and 4 is used to increase the PSR at frequencies below 1 MHz, referred to as the DC PSR. The DC PSR is usually lower than 50 dB for the capacitor-less LDO (100) to achieve stability for wide load conditions. This is because the feedback network gain is decreased in order to guarantee that the inner loop does not have any stability issues for the wide variations of load capacitance. Having a DC PSR lower than 50 dB is not suitable for many applications. FIG. 5 is a schematic circuit diagram of a supply rejection circuit (500) in accordance with embodiments of the invention. In one or more embodiments, the supply rejection circuit (500) is used to implement the circuit element (13) in the improved feedback network shown in FIGS. 3 and 4. The supply rejection circuit (500) is used as an additional ripple rejection circuit that injects the supply ripples at node (3) of the circuit element (13) in FIGS. 3 and 4, which propagate to the gate of the pass transistor $M_{pass}$ (i.e., circuit element (9)) to cancel out the effects of input ripples. Hence, a higher PSR is achieved at DC. The pass transistor is represented as $G_{m,pass}$ in FIGS. 3 and 4. The input ripples are any supply noise appearing at the input terminal Vin of the LDO (100) of FIG. 1 or LDO (400) of FIG. 4. Although a specific circuit configuration (i.e., based on a current mirror circuit) is shown in FIG. 5 to implement ripple injection, those skilled in the art, with the benefit of this disclosure will appreciate that other circuit configurations may also be used to replicate supply noise for injecting to a particular circuit node in the LDO.

Figure 6:
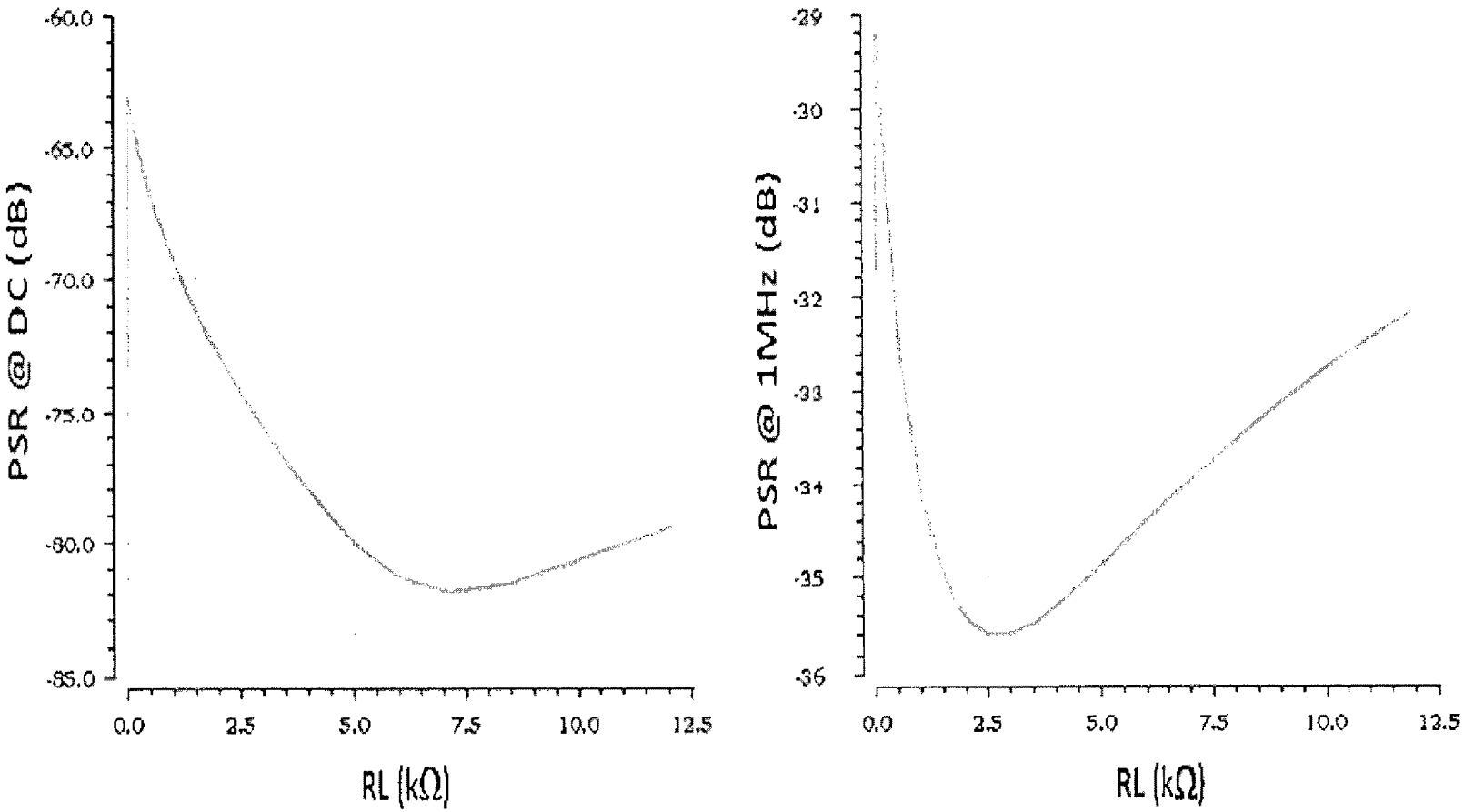
FIG. 6 shows screenshots of example simulation results of LDO linear voltage regulator power supply rejection in accordance with embodiments of the invention.

Simulations show that the LDO PSR is enhanced by at least 10 dB across a wide frequency range using the supply rejection circuit (500). FIG. 6 shows the simulation results for the PSR at DC and 1 MHz. As shown, a PSR higher than 65 dB and 30 dB are achieved at DC and at 1 MHz, respectively, for a wide range of load conditions. This simulation was done for a load capacitance of 1 nF and load currents of up to 500 mA. The simulation circuit parameters include an open loop gain higher than 60 dB, a gain-bandwidth product lower than 5 MHz, and an amplifier offset better than 5 mV.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A linear voltage regulator (LVR) circuit, comprising: a resistive divider; a first amplifier having a first input coupled to an output of the resistive divider and a first output coupled to a second amplifier; the second amplifier having a second input coupled to the first output of the first amplifier and a second output coupled to a third amplifier; the third amplifier having a third input coupled to the second output of the second amplifier and a third output driving a pass transistor; the pass transistor having a gate terminal driven by the third amplifier, a first terminal coupled to an input of the LVR circuit, and a second terminal coupled to an output of the LVR circuit; a first capacitor coupling the output of the LVR circuit and the first output of the first amplifier; a second capacitor in series with a variable resistor coupling the second input and the second output of the second amplifier, wherein the variable resistor automatically adapts its value based on a voltage level of the second output of the second amplifier, wherein the voltage level of the second output of the second amplifier depends on a load current at the output of the LVR circuit; a first transconductance amplifier having a fourth input coupled to the output of the resistive divider and a fourth output coupled to the second output of the second amplifier; and a second transconductance amplifier having a fifth input coupled to the first output of the first amplifier and a fifth output coupled to the output of the LVR circuit.

2. The LVR circuit of claim 1, wherein the first amplifier has a separate input coupled to a reference voltage, and wherein the resistive divider is used to scale up the reference voltage.

3. The LVR circuit of claim 1, wherein the second amplifier is a transconductance amplifier configured to increase the loop gain of the LVR circuit.

4. The LVR circuit of claim 1, wherein the third amplifier has a low gain to stabilize the LVR circuit for load currents up to 500 mA and load capacitance larger than tens of nano-Farads.

5. The LVR circuit of claim 1, wherein the resistor in series with the second capacitor is a variable resistor wherein a value thereof is adapted based on a load current to satisfy a stability requirement of the LVR.

6. The LVR circuit of claim 1, wherein one or more of the resistive divider, the first amplifier, the second amplifier, the third amplifier, the pass transistor, the first capacitor, the second capacitor, the first transconductance amplifier, and the second transconductance amplifier are included in a semiconductor integrated circuit.

7. The LVR circuit of claim 1, wherein the pass transistor is at least one selected from a group consisting of an n-type field effect transistor, a p-type field effect transistor, and a bipolar junction transistor.

8. A linear voltage regulator (LVR) circuit, comprising a resistive divider; a first amplifier having a first input coupled to an output of the resistive divider and a first output coupled to a second amplifier; the second amplifier having a second input coupled to the first output of the first amplifier and a second output coupled to a third amplifier; the third amplifier having a third input coupled to the second output of the second amplifier and a third output driving a pass transistor; the pass transistor having a gate terminal driven by the third amplifier, a first terminal coupled to an input of the LVR circuit, and a second terminal coupled to an output of the LVR circuit; a first capacitor coupling the output of the LVR circuit and the first output of the first amplifier a second capacitor in series with a variable resistor coupling the second input of the second amplifier and the second output of the second amplifier, wherein the variable resistor automatically adapts its value based on a voltage level of the second output of the second amplifier, wherein the voltage level of the second output of the second amplifier depends on a load current at the output of the LVR circuit; and a supply rejection circuit having a fourth input coupled to the input of the LVR circuit and a fourth output coupled to the second output of the second amplifier.

9. The LVR circuit of claim 8, wherein the supply rejection circuit is implemented as a current mirror circuit that is configured to inject input ripples into the LVR circuit to cancel out an effect of the input ripples.

10. The LVR circuit of claim 9, wherein one or more of the resistive divider, the first amplifier, the second amplifier, the third amplifier, the pass transistor, the capacitor, and the current mirror circuit are included in a semiconductor integrated circuit.

11. The LVR circuit of claim 8, wherein the pass transistor is at least one selected from a group consisting of an n-type field effect transistor, a p-type field effect transistor, and a bipolar junction transistor.

12. A method to maintain stability of a low drop-out (LDO) linear voltage regulator over a plurality of capacitive load conditions ranging from no capacitive load to tens of nano-Farads loads, comprising: sensing, by a voltage controlled variable resistor, a node voltage in a feedback network of the LDO linear voltage regulator, wherein the feedback network comprises an error amplifier configured to regulate an output voltage level of the LDO linear voltage regulator based on a reference voltage, wherein the node voltage has a dependency on a resistive load current of the LDO linear voltage regulator; and adjusting, by the voltage controlled variable resistor and based on the sensed node voltage, a resistance value of an adaptive RC network in the feedback network, wherein the adaptive RC network produces an adaptive zero in a transfer function of the feedback network, wherein the adaptive zero reduces phase margin degradation due to an output non-dominant pole in the transfer function, and wherein a frequency of the adaptive zero is inversely proportional to the resistance value of the adaptive RC network.

13. The LVR of claim 8, wherein the supply rejection circuit is configured to reduce a process variation effect by injecting signals to the LVR circuit based on ratios of resistance and transconductance.

* * * * *